United States Patent [19]

Shimotori et al.

[11] 4,155,782

[45] May 22, 1979

[54] WATCH CASE

[75] Inventors: Kazumi Shimotori, Kawasaki; Itaru Watanabe, Yokohama; Masako Nakahashi, Tokyo; Shuichi Komatsu, Yokohama, all of Japan

[73] Assignee: Tokyo Shibaura Electric Co., Ltd., Kawasaki, Japan

[21] Appl. No.: 740,097

[22] Filed: Nov. 9, 1976

[30] Foreign Application Priority Data

Nov. 12, 1975 [JP] Japan ..... 50-135847

[51] Int. Cl.[2] ..... C22C 19/05

[52] U.S. Cl. ..... 148/32.5; 58/88 R; 75/171; 148/162

[58] Field of Search ..... 75/171, 170; 148/32, 148/32.5, 162; 58/88 R

[56] References Cited

U.S. PATENT DOCUMENTS

| | | | |
|---|---|---|---|
| 3,015,558 | 1/1962 | Grant et al. | 75/171 |
| 3,635,703 | 1/1972 | Pissarevsky | 75/171 |

*Primary Examiner*—R. Dean

*Attorney, Agent, or Firm*—Oblon, Fisher, Spivak, McClelland & Maier

[57] ABSTRACT

A watch case made of an alloy consisting essentially of 30 to 45% by weight of Cr, 2.5 to 5.0% by weight of Al and the balance essentially Ni, said alloy having been subjected to an aging treatment. The watch case is high in hardness and corrosion resistance and presents a good mirror-like surface.

5 Claims, 3 Drawing Figures

WATCH CASE

BACKGROUND OF THE INVENTION

This invention relates to a casing of a watch like a wrist watch.

Generally, a casing of a watch like a wrist watch, as shown in appended FIGS. 1 and 2, is exposed to the atmosphere for a long time and, in addition, kept in contact with the skin of a human being. Accordingly, the casing tends to be corroded by the sweat or rainwater deposited thereon. Further, the surface of the casing is likely to be damaged by external impacts. It follows that the material of a watch case should have a corrosion resistance and a hardness high enough to withstand the severe wear conditions in which the watch case is placed.

Austenite stainless steel (for example, AISI 304) is widely used as the material of a watch case. Indeed, this material is high in corrosion resistance, but is not satisfactory in terms of hardness. Specifically, Vickers hardness ($H_v$) of this material is about 250. Thus, where a watch case is made of stainless steel, much labor is required for the final step of planishing. Moreover, about six months to about one year after the use, the surface of the watch case tends to bear bruises, resulting in the loss of metal luster and beauty.

To remove the drawbacks mentioned above, various materials are under development for use as the material of a watch case. For example, available is a watch case of a high hardness prepared by subjecting a sintered alloy of Cr-Mo-Wo-Fe system, which is inferior in cutting of machining And, the article obtained by a powder metallurgical method is not satisfactory in dimensional accuracy and, thus, not suitable for use as a watch case requiring a high degree of precision. In addition, the article mentioned is weak against impacts and bears a great number of micro pores, rendering it difficult to supply surface treatments such as planishing to the article.

SUMMARY OF THE INVENTION

An object of this invention is to provide a watch case made of a material good in cutting capability, high in hardness, corrosion resistance and nonmagnetic character and presenting a good mirror-like surface.

A watch case according to this invention is made of an alloy consisting essentially of 30 to 45% by weight of Cr, 2.5 to 5% weight of Al, and the blance essentially Ni, preferably, 36 to 40% by weight of Cr, 3.0 to 4.5% by weight of Al, and balance essentially Ni. The alloy of this composition has Vickers hardness ($H_v$) of about 200 after a solid solution treatment which make the formability easy and about 600 or more after an aging treatment which improve the wear resistance and planishing process of the surface.

DETAILED DESCRIPTION OF THE PREFERRED EMBODIMENTS

This invention is based on the finding that, when Al is added to a Ni-Cr alloy bearing high Cr content and the system of Ni-Cr-Al is subjected to a solid solution treatment, the resultant material becomes soft and excellent in cutting capability and shaping capability utilizing plastic deformation. Moreover, if the material subjected to a solid solution treatment is further subjected to an aging treatment marked improvements are achieved in both hardness and mirror-like surface, rendering the material suitable for making a watch case. It is important to note in this connection that Al is a directly element forming GCP (Geometrically Close-packed Phase) and indirect $\alpha$-Cr promoting element within a Ni-Cr alloy.

The alloy of Ni-Cr-Al system used in this invention is capable of attaining extremely high age-hardenability because of the duplex precipitation of $\alpha$-phase, $\gamma$-phase, GCP $\gamma'$-phase when subjected to an aging treatment, rendering the alloy hard enough to provide a satisfactory material of a watch case. In this case, Ni itself is highly resistant against corrosion and contributes to the improvement in ductility of the alloy. Cr itself is also highly corrosion-resistant and promotes the $\alpha$-phase precipitation by a grain boundary reaction. The amount of Cr necessary for $\alpha$-phase precipitation in laminar form, not in granular form, ranges from 30% by weight to 55% by weight. But, since the ductility of the alloy is markedly reduced when the Cr content exceeds 45% by weight, the Cr content should fall within the range of from 30 to 45% by weight when the alloy is used for making a watch case.

Figure 1:
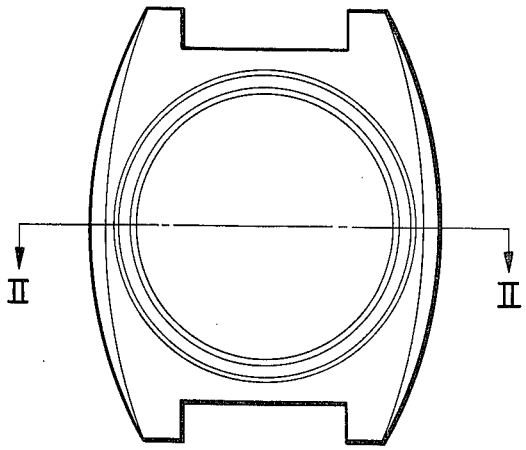
FIG. 1 is a schematic diagram showing a casing of a general type wrist watch.
Figure 2:
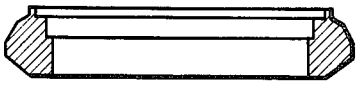
FIG. 2 is a cross sectional view as observed from line II—II of FIG. 1.
Figure 3:
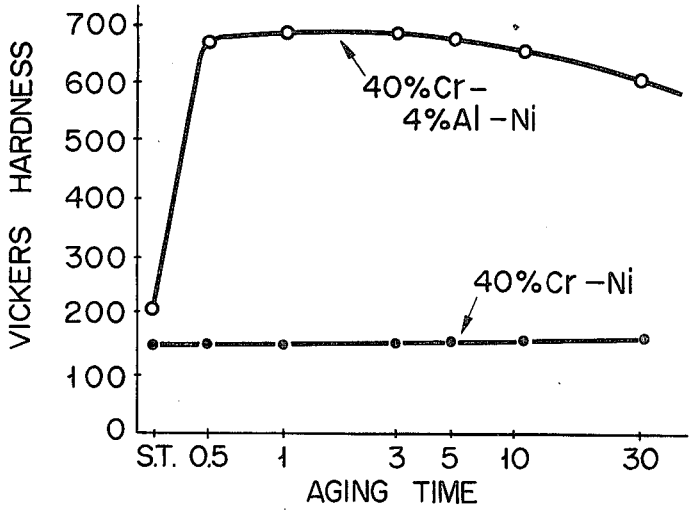
FIG. 3 is a graph showing the relationship between Vickers hardness and aging time for an alloy constituting the material of a watch case according to this invention and the general type alloy of Cr-Ni.

Al serves to form a GCP of $\gamma'$-$Ni_3Al$, thereby promoting the duplex precipitation of $\gamma$, $\gamma'$-$Ni_3Al$ and $\alpha$-Cr phases. Namely, the Al addition is prominently effective for increasing the hardness of the alloy after the aging treatment as seen from FIG. 2. Specifically, the comparison was made between an alloy of 40% Cr-4% Al-Ni system and the base alloy of 40% Cr-Ni system. For each case, the alloy was subjected to a solid solution treatment for 1 hour at 1200° C., followed by an aging treatment at 700° C. FIG. 2 shows that the alloy of CrNi system little varies in hardness in spite of the aging treatment in contrast to the alloy containing 4% by weight of Al, which showed a marked increase in hardness after the aging treatment. Clearly, the Al-containing alloy has an abrasion resistance high enough to be used for making a watch case.

If the Al content of the alloy does not reach 2.5% by weight, a sufficient precipitation of duplex phases is not obtained, rendering the Vickers hardness of the alloy after the aging treatment as low as about 350. In this case, the hardness of the alloy is insufficient for making a watch case. On the other hand, if the Al content exceeds 5.0% by weight, the Vickers hardness of the alloy after the solid solution treatment exceeds 300, leading to an extreme decrease in fabricability of the alloy such as cutting capability, castability and forgiability. It follows that a suitable amount of Al ranges from 2.5 to 5.0% by weight.

Particularly, when the alloy of Ni-Cr-Al system contains 36 to 40% by weight of Cr and 3.0 to 4.5% by weight of Al, the difference in Vickers hardness of the alloy before and after the aging treatment becomes as high as 400 or more, rendering the alloy very much suitable for making a watch case.

A further addition of Ti or exchange of Al by Ti addition to the alloy of Ni-Cr-Al system serves to lower the precipitation speed of the duplex phases, resulting in further improvement in hardness of the alloy, as is the case with the conventional Ni-based alloy. Also an addition of Mo or Co serves to improve the corrosion resistance of the alloy and lower the precipitation speed of the duplex phases.

Still further, the abrasion resistance of the alloy can be more increased by adding Si in an amount of 2% by weight or less. Of course, it is also possible to add traces of Mn as a deoxidizer.

The alloy of the composition specified previously is subjected to a solid solution treatment and, then, to a cutting operation into the shape of a watch case, followed by an aging treatment and polishing.

Specifically, an alloy consisting essentially of Cr (30 to 45% by weight), Al (2.5 to 5% by weight) and Ni (balance) is heated at 1000° to 1200° C. for a solid solution treatment, thereby allowing the alloy to be of $\gamma$-single phase. There is no restriction with respect to the heating time at this step, though the treating time can naturally be shortened if the alloy is heated at a higher temperature. In terms of efficiency in work, it is preferred to carry out the solid solution treatment at 1100° to 1200° C. for several minutes to scores of minutes.

The alloy subjected to the solid solution treatment is then, cut into a shape of a watch case. Since the alloy mentioned has a Vickers hardness of about 200, which is lower than the value of an austenite stainless steel used for making a watch case, the cutting work can be effected accurately and easily. Incidentally, the shaping can be carried out by forging, precision investment casting, etc. besides the cutting mentioned.

The watch case thus shaped is subjected to an aging treatment at 500° to 950° C., at 550° to 700° C., and then polishing. By this aging treatment, duplex phases consisting of $\alpha$-, $\gamma$- and $\gamma'$- phases of laminar state is precipitated within the alloy, resulting in a marked increase in hardness of the alloy. It suffices to carry out the aging treatment for about 30 minutes, an unreasonably long aging treatment tends to decrease the hardness of the resultant alloy.

If the temperature at the aging treatment is lower than 500° C. and, in particular, if the Al content of the alloy is insufficient, the $\gamma'$-phase deposition is insufficient and, thus, the effect of the duplex precipitation is weakened. If the temperature exceeds 900° C., the complex phase becomes granular, not lamelar, resulting in decreased hardness of the treated alloy. Incidentally, the temperature condition mentioned is for the case where the shaped alloy is free from residual stress. If there is residual stress introduced by cold forging etc., the temperature for the aging treatment should be lowered appropriately.

Comparative tests were conducted between the alloys specified in this invention and those falling outside the scope of this invention. Table 1 shows the compositions of the alloys used in the comparative tests. It is seen that samples 1 to 8 fall within the scope of this invention and samples 9 to 15 provide control cases.

Each of the alloys was subjected to a solid solution treatment at 1200° C. for one hour. Table 2 shows the Vickers hardness of each sample measured after the solid solution treatment. The samples were then subjected to aging treatments for 30 minutes at 700° C. Table 2 also shows the Vickers hardness of each sample measured after the aging treatment.

Table 1

| Sample No. | Composition (% by weight) Cr | Al | Ni |
|---|---|---|---|
| 1 | 33 | 4.2 | balance |
| 2 | 39.20 | 2.50 | " |
| 3 | 38.00 | 3.00 | " |
| 4 | 37.95 | 3.25 | " |
| 5 | 38.01 | 3.50 | " |
| 6 | 37.99 | 3.80 | " |
| 7 | 38.00 | 5.00 | " |
| 8 | 43.5 | 2.9 | " |
| 9 | 39.01 | — | " |
| 10 | 39.00 | 1.10 | " |
| 11 | 39.81 | 2.01 | " |
| 12 | 38.11 | 5.34 | " |
| 13 | 48.10 | 1.52 | " |
| 14 | 28.31 | 2.20 | " |
| 15 | 27.53 | 3.61 | " |

Table 2

| Sample No. | Vickers hardness: After solid solution treatment (1200° C. × 1 hr) | After aging treatment (700° C. × 0.5 hr) |
|---|---|---|
| 1 | 170 | 590 |
| 2 | 175 | 500* |
| 3 | 180 | 600 |
| 4 | 185 | 630 |
| 5 | 190 | 650 |
| 6 | 200 | 660 |
| 7 | 260 | 670 |
| 8 | 295 | 680 |
| 9 | 160 | 165 |
| 10 | 165 | 170 |
| 11 | 170 | 175 |
| 12 | 300 | 680 |
| 13 | 340 | 450** |
| 14 | 145 | 200** |
| 15 | 190 | 235** |

*Ten (10) hours of aging treatment
**Aging treatment at 800° C.

Table 2 shows that, where the Cr content exceeds 45% (sample 13) or the Al content exceeds 5.0% (sample 12), the Vickers hardness of the alloy after the solid solution treatment becomes as high as 300 or more, rendering it difficult to apply a fabrication method such as plastic forming, maching, melting and casting to the alloy because of high Cr-Ni-Al alloy base. Obviously, the alloy of the composition mentioned is unsuitable for making a watch case. Table 2 also shows that, where the Cr content does not reach 30% or the Al content is less than 2.5% the Vickers hardness of the alloy after the aging treatment does not reach 500, failing to provide a material hard enough to be used for making a watch case. In addition, the resultant material is insufficient in terms of abrasion resistance and fails to shorten the time for the final step of planishing.

The alloy of sample 6, i.e., the alloy containing 37.99% by weight of Cr, 3.80% by weight of Al and the balance of Ni, provides the most suitable material for making a watch case. Vickers hardness of this alloy after the solid solution treatment was 200, which is lower than the value of a special stainless steel used for making a watch case. Clearly, the alloy of the above-noted composition facilitates the succeeding step of cutting operation into the shape of a watch case. In addition, the Vickers hardness of this alloy after the aging treatment was 660. An alloy of a hardness of this level is difficult to be filed and weared, thus, presents a watch case of a clearly planished surface.

After the aging treatment, each of the samples 1 to 8 was rubbed to provide a test piece of a mirror-like surface, 10 mm in diameter and 10 mm in thickness. In view of the decorative nature of a watch case, the appearance of the surface is very important. In this case, each of the test pieces showed a good mirror-like surface. Further, the planishing step was considerably efficient with the high level of Vickers hardness.

In order to look into the corrosion resistance, the polished test pieces were immersed in (1) an aqueous solution of 20% NaCl, (2) an aqueous solution of 5% $NH_4OH$, (3) an aqueous solution of 5% $H_2SO_4$ and (4) an aqueous solution of 5% lactic acid, respectively. The test pieces were found to retain the initial metal luster and beauty 75 hours after the immersion. It follows that the alloy for making a watch case according to this invention has a corrosion resistance equal to or higher than that of stainless steel.

As described in detail, a watch case made of an alloy consisting essentially of 30 to 45% by weight of Cr, 2.5 to 5.0% by weight of Al and the balance essentially Ni and having been subjected to an aging treatment is very much advantageous. First of all, the watch case mentioned has a corrosion resistance equal to or higher than that of a conventional watch case made of stainless steel. In addition, the watch case according to this invention has as high as 500 or more of Vickers hardness and, thus, is very difficult to be abraded and presents a good mirror-like surface of a metal luster. The effects mentioned are prominent particularly when the Cr content ranges from 30 to 40% by weight and the Al conent falls within the range of from 3,0 to 4.5% by weight.

What we claim is:

1. A watch case having a good mirror-like surface, said watch case made of an alloy consisting essentially of 30 to 45% by weight of Cr, 2.5 to 5% by weight of Al and the balance essentially Ni, said alloy having been subjected to an aging treatment, and said alloy having a Vickers hardness larger than 500 after said aging treatment.

2. The watch case of claim 1 wherein said alloy consists essentially of 37.99% by weight of Cr, 3.8% by weight of Al and the balance Ni.

3. The watch case of claim 1 wherein said aging treatment is carried out at a temperature between 500° and 950° C. for about 30 minutes.

4. The watch case of claim 3 wherein said aging treatment is carried out at a temperature of 550° to 700° C. for about 30 minutes.

5. The watch case of claim 1 wherein said alloy after the aging treatment has a Vickers hardness larger than 600.

* * * * *